US005305702A

United States Patent [19]

Phillips

[11] Patent Number: 5,305,702

[45] Date of Patent: Apr. 26, 1994

[54] VESSEL OPENING REPAIR APPARATUS

[76] Inventor: Donald E. Phillips, 350 Whitmore Rd., Dangerfield, Tex. 75638

[21] Appl. No.: 44,755

[22] Filed: Apr. 12, 1993

[51] Int. Cl.[5] ..... B63B 43/16

[52] U.S. Cl. ..... 114/227

[58] Field of Search ..... 114/227–229; 138/98; 220/233–239

[56] References Cited

U.S. PATENT DOCUMENTS

| | | | |
|---|---|---|---|
| 17,852 | 7/1857 | Woodville | 114/227 |
| 417,894 | 12/1889 | Winchester | 114/227 |
| 1,249,422 | 12/1917 | Kook | 114/227 |
| 2,574,859 | 11/1951 | Chisholm | 114/227 |

FOREIGN PATENT DOCUMENTS

| | | | |
|---|---|---|---|
| 188561 | 11/1922 | United Kingdom | 114/227 |

*Primary Examiner*—Edwin L. Swinehart
*Attorney, Agent, or Firm*—Leon Gilden

[57] ABSTRACT

A central shaft is arranged for positioning through an opening within a vessel hull, with the central shaft including first and second collars spaced to slidably mount a second collar, wherein a first collar is positioned in adjacency relative to a first end of the shaft, with the first collar having a plurality of positioning legs pivotally mounted to the first collar, and the positioning legs each including a link pivotally mounting each positioning leg to the second collar. A central mounting web includes a pneumatic chamber for effecting a fluid-tight sealing relationship against the hull, with the mounting web including the central shaft directed therethrough, having an externally threaded portion that threadedly receives a lock collar. A pull handle directed through the shaft in adjacency to the lock collar permits pivoting in an over-center relationship of the positioning legs relative to the first collar to permit the positioning and subsequent replacement and removal of the apparatus relative to the ship hull.

6 Claims, 4 Drawing Sheets

FIG. 7
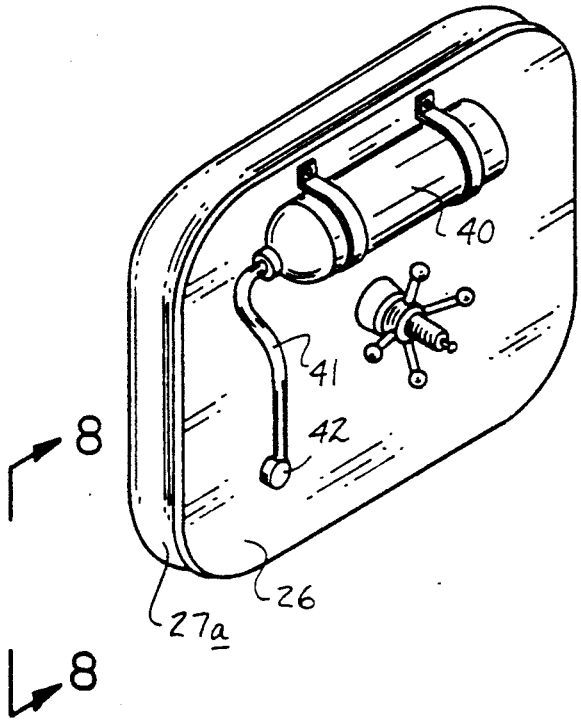
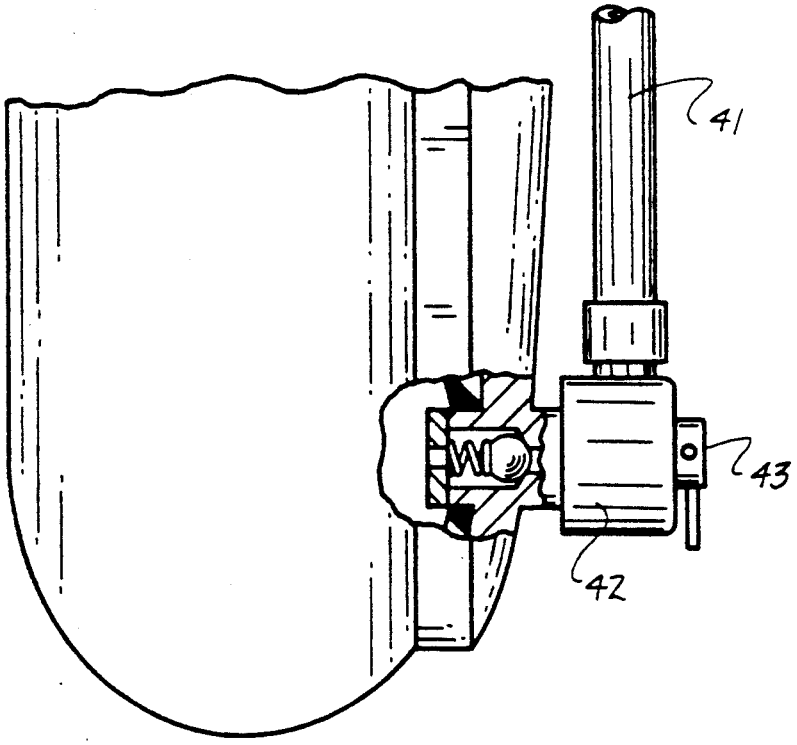
FIG. 8

VESSEL OPENING REPAIR APPARATUS

BACKGROUND OF THE INVENTION

1. Field of the Invention

The field of invention relates to vessel repair apparatus, and more particularly pertains to a new and improved vessel opening repair apparatus wherein the same is directed to the sealing in a fluid-tight relationship of a vessel hull for temporary repair thereof.

2. Description of the Prior Art

Hull repair is indicated in the prior art and typified by the U.S. Pat. Nos. 3,669,055; 5,009,180; 4,712,502; 4,161,155; and 4,569,303.

The instant invention attempts to overcome deficiencies of the prior art by providing for an apparatus arranged for ease of one-man repair of a ship vessel hull opening and in this respect, the present invention substantially fulfills this need.

SUMMARY OF THE INVENTION

In view of the foregoing disadvantages inherent in the known types of vessel repair apparatus now present in the prior art, the present invention provides a vessel opening repair apparatus wherein the same is directed to the positioning of a pneumatic seal in surrounding relationship relative to an opening within a ship hull. As such, the general purpose of the present invention, which will be described subsequently in greater detail, is to provide a new and improved vessel opening repair apparatus which has all the advantages of the prior art vessel repair apparatus and none of the disadvantages.

To attain this, the present invention provides a central shaft arranged for positioning through an opening within a vessel hull, with the central shaft including first and second collars spaced to slidably mount a second collar, wherein a first collar is positioned in adjacency relative to a first end of the shaft, with the first collar having a plurality of positioning legs pivotally mounted to the first collar, and the positioning legs each including a link pivotally mounting each positioning leg to the second collar. A central mounting web includes a pneumatic chamber for effecting a fluid-tight sealing relationship against the hull, with the mounting web including the central shaft directed therethrough, having an externally threaded portion that threadedly receives a lock collar. A pull handle directed through the shaft in adjacency to the lock collar permits pivoting in an overcenter relationship of the positioning legs relative to the first collar to permit the positioning and subsequent replacement and removal of the apparatus relative to the ship hull.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vessel opening repair apparatus which has all the advantages of the prior art vessel repair apparatus and none of the disadvantages.

It is another object of the present invention to provide a new and improved vessel opening repair apparatus which may be easily and efficiently manufactured and marketed.

It is a further object of the present invention to provide a new and improved vessel opening repair apparatus which is of a durable and reliable construction.

An even further object of the present invention is to provide a new and improved vessel opening repair apparatus which is susceptible of a low cost of manufacture with regard to both materials and labor, and which accordingly is then susceptible of low prices of sale to the consuming public, thereby making such vessel opening repair apparatus economically available to the buying public.

Still yet another object of the present invention is to provide a new and improved vessel opening repair apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a further modified aspect of the invention having a self-filling cannister.

FIG. 8 is an orthographic view taken along the lines 8—8 of FIG. 7 in the direction indicated by the arrow.

DESCRIPTION OF THE PREFERRED EMBODIMENT

Figure 1:
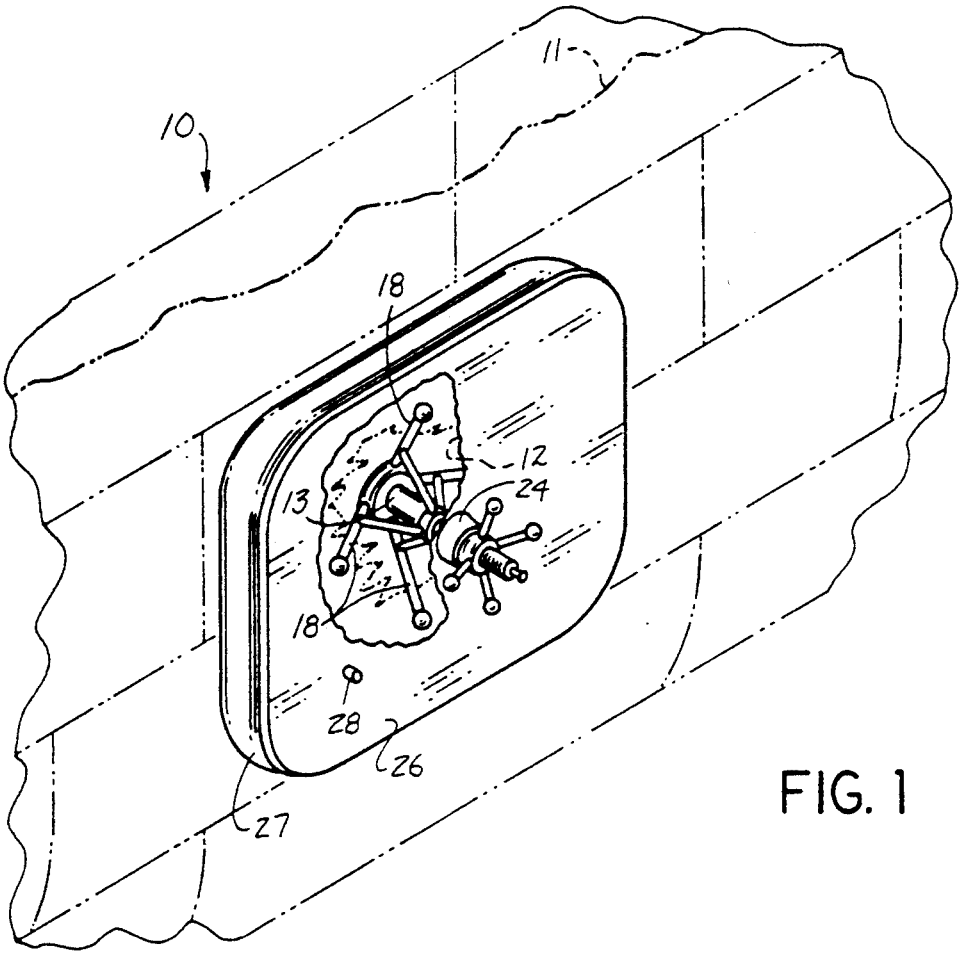
FIG. 1 is an isometric illustration of the invention is use.

With reference now to the drawings, and in particular to FIG. 1 thereof, a new and improved vessel opening repair apparatus embodying the principles and concepts of the present invention and generally designated by the reference numeral 10 will be described.

Figure 2:
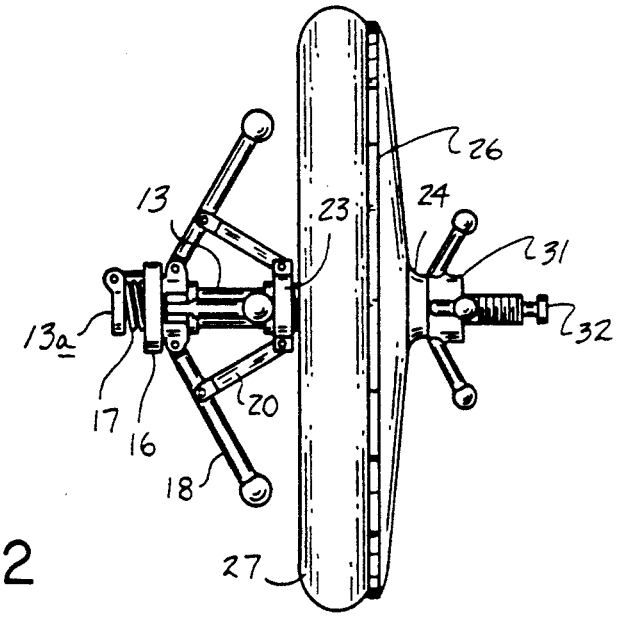
FIG. 2 is an orthographic side view of the invention.
Figure 3:
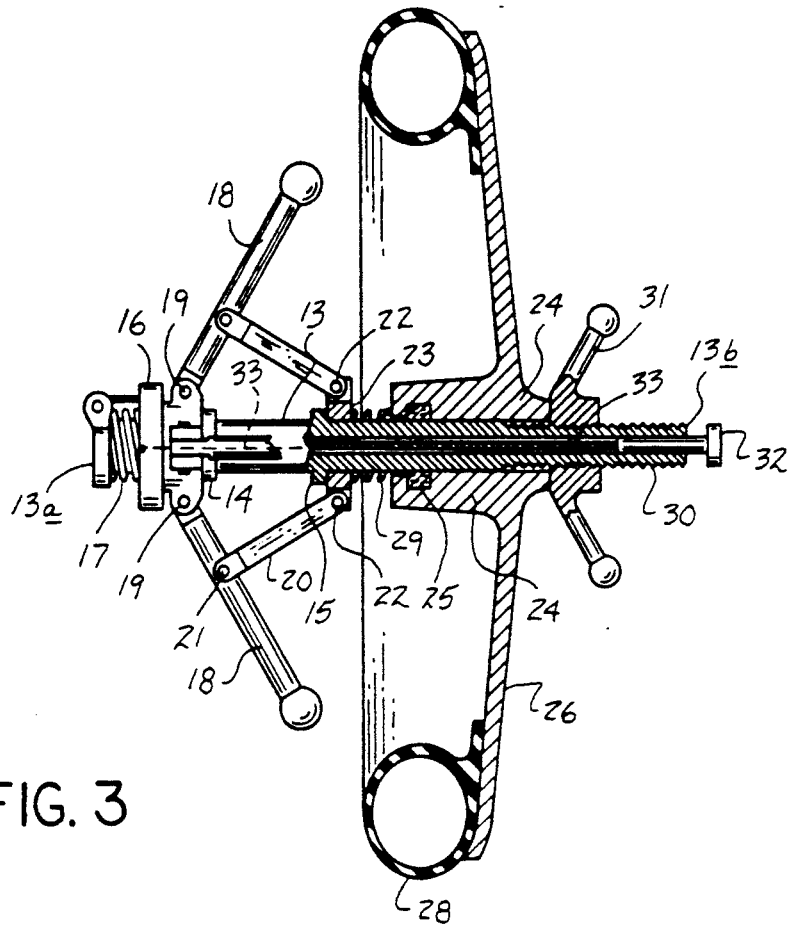
FIG. 3 is an orthographic cross-sectional illustration of the invention.
Figure 4:
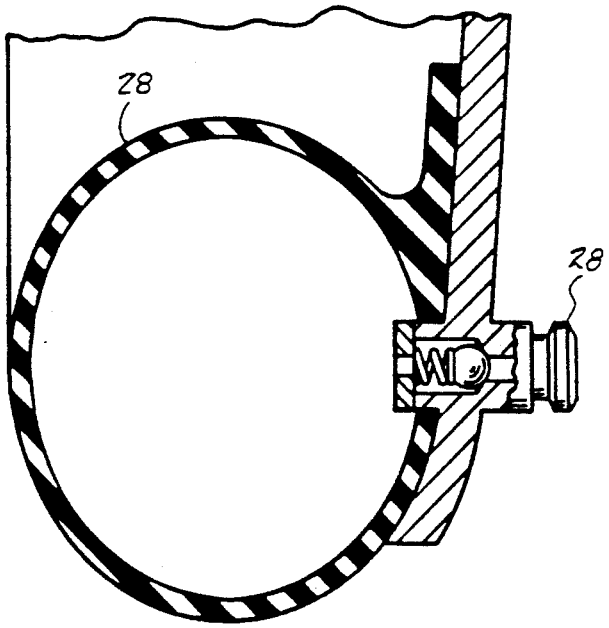
FIG. 4 is an enlarged cross-sectional illustration of the pneumatic chamber.

More specifically, the vessel opening repair apparatus 10 of the instant invention essentially comprises mounting to a vessel hull 11 having a hull opening 12. To this end, a central shaft 13 is directed through the hull opening, as indicated in FIG. 1, with the central shaft 13 having a central shaft first end cap 13*a* (see FIG. 2) mounted to the first end of the central shaft 13, with a central shaft second end 13*b* positioned in an opposed end of the longitudinally aligned central shaft 13, as indicated. A first flange 14 slidably mounted to the central shaft 13 is spaced from a second flange 15 fixedly mounted to the central shaft 13 and mounted in a spaced relationship relative to one another with the central shaft, with second collar spring 29 positioned between the second collar 23 and the central hub 24 that in turn receives a central shaft 13 coaxially therethrough for receiving the central shaft 13 coaxially through the central hub 24. A first collar 16 is mounted slidably along the central shaft between the first flange 14 and the first end cap 13*a*, with the first collar 16 including a first spring member 17 interposed between the first collar 16 and the first end cap 13*a*. A plurality of positioning legs 18 each include a leg first pivot axle 19 pivotally mounting a first end of each positioning leg 18 to the first collar 16, with a positioning leg link 20 provided, having a leg link first pivot axle 21 pivotally mounting a first end of each leg link 20 in spaced adjacency relative to the positioning leg first pivot axle 19. The leg link first pivot axle 21 is positioned between the positioning leg first and second ends, as indicated in FIG. 3 for example. A second collar 23 is provided mounted slidably between the second flange 15 and the central hub 24. A sealing gasket 25, as illustrated, is mounted within the hub 24 preventing fluid flow through the hub along the shaft 13. A central hub mounting web 26 extends from the hub 24 and includes a continuous resilient pneumatic chamber 27 mounted to the mounting web 26 in a facing relationship relative to the positioning legs 18. A valve 28 permits selective pneumatic filling of the pneumatic chamber 27. As noted, a second collar spring 29 is interposed between the hub 24 and the second collar 23 to maintain a biased relationship of the second collar relative to the hub in use. A central shaft externally threaded surface 30 is directed between the second collar and extends to the central shaft second end 13*b* to threadedly receive an internally threaded lock collar 31 to permit selective projection and tightening of the pneumatic chamber 27 against a ship hull, as illustrated in FIG. 1. Release of the organization in addition to the threaded removal of the lock collar 31 includes a pull handle coaxially directed through the central shaft extending from the shaft second end 13*b*, wherein the pull handle includes a pull handle shaft 33 directed through the shaft and fixedly mounted to the first collar 16. Pulling of the pull handle shaft 33 effects sliding of the first collar 16 in association with a first collar flange 14 that is also slidably mounted relative to the shaft 13, and sliding the assembly of the first collar and the first flange along the shaft to thereby effect over-centering of the positioning legs 18 rotating the positioning legs 18 rearwardly over the first end cap 13*a* permitting pulling of the assembly through the vessel opening 12.

Figure 5:
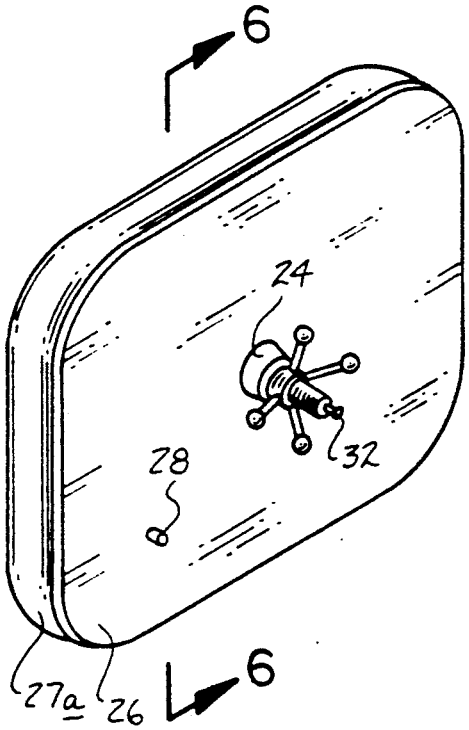
FIG. 5 is an isometric view of a modified aspect of the invention.
Figure 6:
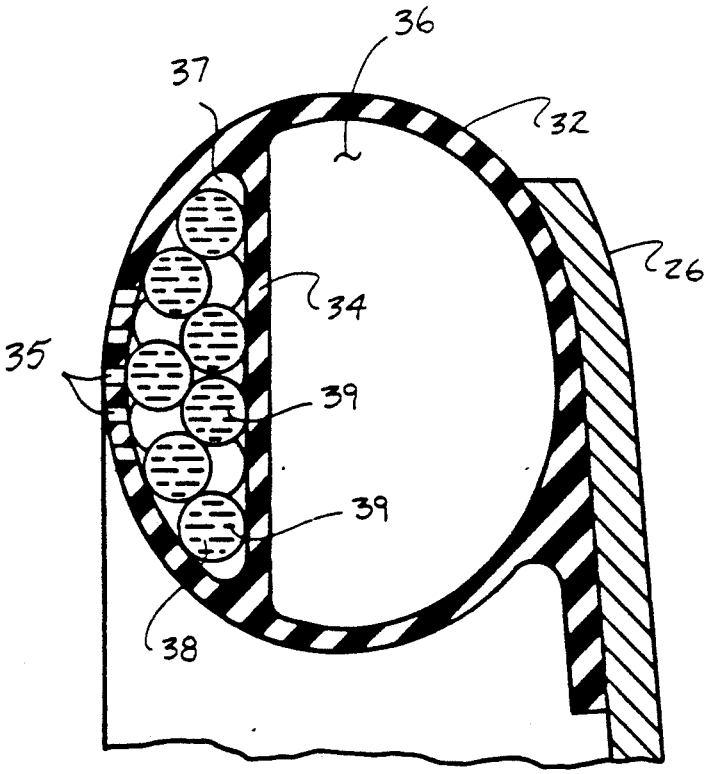
FIG. 6 is an orthographic view taken along the lines 6—6 in the direction indicated by the arrows.

The FIGS. 5 and 6 indicates the use of a modified chamber structure 27*a*, having a chamber partition wall 34 dividing the chamber 27 into a first cavity 36 and a second cavity 37, wherein the second cavity 37 includes a plurality of frangible capsules 38 therewithin, each including a fluid lubricant to communicate the capsules 38 within the second cavity 37 through chamber apertures 35 directed through the outer wall of the chamber 27*a* against the ship hull to further secure the modified pneumatic chamber 27*a*, such that the fluid lubricant 39 enhances sealing of the chamber 27*a* against the hull 11. Further, a pneumatic storage cylinder 40, as illustrated in FIG. 7, having a storage cylinder conduit 41 directing pneumatic pressurized air through the conduit 41 and through a conduit coupling 42 mounting the conduit 41 to the valve 28, wherein the coupling 42 further includes a coupling valve 43 to further provide for selective fluid flow for the coupling valve 43 into the valve 28 from the conduit 41. In this manner, a unitary organization arranged for expediency in the sealing of a vessel opening 12 is provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vessel opening repair apparatus, comprising, a central shaft, the central shaft having a first end, the first end including a first end cap, and the shaft including a second end spaced from the first end, and a first flange mounted to the central shaft, and a first collar slidably mounted to the central shaft between the first flange and the first end cap, wherein the first collar includes a plurality of positioning legs, with each positioning leg including a leg first end spaced from a leg second end, with each leg first end including a leg axle pivotally mounting the leg first end relative to the collar, and a first spring interposed between the first end cap and the first collar, and a second flange fixedly mounted to the shaft spaced from the first collar, and a central hub coaxially aligned with the shaft and slidably receiving the shaft therethrough positioned between the second flange and the shaft second end, with the central hub including a central web, and the web having a pneumatic chamber mounted to the web extending from the web towards the shaft first end, and a fill valve permitting pneumatic pressurization of the chamber, and a second collar slidably mounted along the shaft interposed between the hub and the second flange, and the second collar including a plurality of leg links, with each leg link of said leg links pivotally mounted at a link first end to one of said positioning legs, and each leg link having a link second end pivotally mounted to the second collar, and release means coaxially directed through the central shaft extending from the shaft second end and secured to the first collar to coaxially displacing the first collar along the shaft and pivoting the positioning legs about the first collar.

2. An apparatus as set forth in claim 1 including a second spring interposed between the second collar and the hub biasing the second collar to the second flange.

3. An apparatus as set forth in claim 2 wherein the release means includes a pull handle shaft coaxially directed through the central shaft projecting beyond the shaft first end terminating in a shaft handle.

4. An apparatus as set forth in claim 3 including a lock collar, with the central shaft externally threaded extending from the hub to the shaft second end, and the lock collar having an internally threaded lock collar bore threadedly receiving the lock collar interposed between the hub and the shaft second end.

5. An apparatus as set forth in claim 4 wherein the pneumatic chamber includes a chamber web oriented orthogonally relative to the central shaft, with the web dividing said chamber into a first cavity and a second cavity, with the second cavity including a plurality of frangible capsules therewithin, and each of the frangible capsules including a fluid lubricant therewithin permitting rupture of the frangible capsules upon compression of the chamber onto a vessel hull, with the chamber having a plurality of chamber apertures in communication with the second cavity through the chamber and in communication with the frangible capsules to permit projection of the fluid lubricant through the apertures.

6. An apparatus as set forth in claim 5 further including a pneumatic storage cylinder mounted to the web, and the storage cylinder including a cylinder conduit extending from the storage cylinder to the valve.

* * * * *